United States Patent [19]

Hackman et al.

[11] Patent Number: 4,766,912

[45] Date of Patent: Aug. 30, 1988

[54] METHOD AND APPARATUS FOR PUFFING TOBACCO

[75] Inventors: Klaus-Georg Hackman; Reinhard Liebe, both of Hamburg; Enno Freesemann, Reinbek; Willi Thiele, Geesthacht; Waldemar Wochnowski, Hamburg, all of Fed. Rep. of Germany

[73] Assignee: Körber AG, Hamburg, Fed. Rep. of Germany

[21] Appl. No.: 106,921

[22] Filed: Oct. 6, 1987

Related U.S. Application Data

[63] Continuation of Ser. No. 940,197, Dec. 12, 1986, abandoned, which is a continuation of Ser. No. 602,187, Apr. 19, 1984, abandoned.

[30] Foreign Application Priority Data

Apr. 23, 1983 [DE] Fed. Rep. of Germany ..... 3314828
Dec. 2, 1983 [DE] Fed. Rep. of Germany ..... 3343603

[51] Int. Cl.[4] ..... A24B 3/18

[52] U.S. Cl. ..... 131/296; 131/291; 131/403

[58] Field of Search ..... 131/291, 296, 403

[56] References Cited

U.S. PATENT DOCUMENTS

| | | | |
|---|---|---|---|
| 3,734,104 | 5/1973 | Buchanan et al. | 131/296 |
| 3,742,961 | 7/1973 | Waller | 131/296 |
| 3,877,469 | 4/1975 | Wochnowski et al. | 131/296 |
| 3,982,550 | 9/1976 | de la Burde et al. | 131/296 |
| 4,044,780 | 8/1977 | Kelly | 131/296 |
| 4,195,647 | 4/1980 | Wochnowski et al. | 131/296 |
| 4,298,012 | 11/1981 | Wochnowski | 131/296 |
| 4,340,073 | 7/1982 | de la Burde et al. | 131/296 |
| 4,407,306 | 10/1983 | Hibbitts | 131/296 |
| 4,414,987 | 11/1983 | Utsch et al. | 131/296 |
| 4,431,011 | 2/1984 | Rothchild | 131/296 |
| 4,460,000 | 7/1984 | Steinberg | 131/296 |
| 4,483,352 | 11/1984 | Egri | 131/296 |
| 4,497,330 | 2/1985 | Banyasz | 131/296 |

FOREIGN PATENT DOCUMENTS

| | | | |
|---|---|---|---|
| 0055541 | 7/1982 | European Pat. Off. | 131/296 |
| 0074534 | 3/1983 | European Pat. Off. | 131/296 |

OTHER PUBLICATIONS

Hauni-Technik 9 Edition: Aug. 1978 (T 278E).

*Primary Examiner*—Vincent Millin
*Attorney, Agent, or Firm*—Peter K. Kontler

[57] ABSTRACT

Fragments of tobacco ribs are puffed in an elongated tunnel which is vibrated to advance the particles from the inlet toward the outlet. The particles in the tunnel are contacted by streamlets of supersaturated or superheated steam at such temperature and pressure that the temperature of the particles is raised to between 100.5° and 120° C. To this end, steam is admitted at 2.5 to 25 bar absolute pressure and at a temperature of between 126° and 400° C. The thus heated particles of tobacco ribs are thereupon dried.

26 Claims, 1 Drawing Sheet

METHOD AND APPARATUS FOR PUFFING TOBACCO

This application is a continuation, of application Ser. No. 940,197, filed Dec. 12, 1986, which is a continuation of Ser. No. 602,187, filed Apr. 19, 1984, both now abandoned.

BACKGROUND OF THE INVENTION

The present invention relates to a method of and to an apparatus for puffing (i.e., for increasing the specific volume of) tobacco, especially for puffing comminuted tobacco ribs. More particularly, the invention relates to a method of puffing particles of tobacco in an apparatus wherein the particles are caused to advance from the inlet to the outlet of a tunnel and are simultaneously contacted by steam.

Commonly owned U.S. Pat. No. 4,298,012 granted Nov. 3, 1981 to Waldemar Wochnowski discloses a method of increasing the specific volume of tobacco ribs by transporting such particles of tobacco with a vibratory conveyor and contacting the thus transported particles with steam. This entails condensation of steam on the particles of tobacco and highly satisfactory heating of the particles so that the liquid which is confined in the interior of the particles evaporates with attendant puffing of the treated material.

OBJECTS AND SUMMARY OF THE INVENTION

An object of the invention is to provide a novel and improved method of puffing particles of tobacco, especially comminuted tobacco ribs, in such a way that the specific volume of the puffed articles is increased beyond that which is achievable in accordance with heretofore known methods.

Another object of the invention is to provide a method which renders it possible to increase the specific volume of tobacco particles by at least 50 percent.

A further object of the invention is to provide a novel and improved method of puffing large quantities of tobacco particles in a small area and with low expenditures in energy.

An additional object of the invention is to provide a novel and improved method of permanently increasing the specific volume of comminuted tobacco leaves.

Still another object of the invention is to provide a method according to which the specific volume of tobacco is increased after a surprisingly short exposure to the action of heating and/or other conditioning media.

An additional object of the invention is to provide a novel and improved apparatus for the practice of the above outlined method.

Another object of the invention is to provide an apparatus which can achieve pronounced puffing of tobacco particles, especially comminuted tobacco ribs, in a small area and with the expenditure of surprisingly small quantities of energy.

Still another object of the invention is to provide the apparatus with novel and improved means for regulating the admission of fluids into contact with tobacco particles in the conditioning zone.

A further object of the invention is to provide a novel and improved tobacco heating and transporting system for use in the above outlined apparatus.

An additional object of the invention is to provide the apparatus with novel and improved means for subjecting freshly puffed tobacco particles to a secondary treatment.

One feature of the invention resides in the provision of a method of increasing the specific volume of (i.e., of puffing) tobacco particles, especially comminuted tobacco ribs. The method comprises the steps of transporting the particles of tobacco into the inlet of, along and through the outlet of a predetermined elongated path, sealing the particles of tobacco in the path from the surrounding atmosphere, at least in regions other than the inlet and the outlet, and contacting the particles of tobacco in the path with steam including conveying steam transversely of the path at a temperature and pressure such that the temperature of tobacco particles (which may be admitted at or above room temperature) is raised to between 100.5° and 120° C. (preferably between 102° and 110° C.) not later than when the particles reach the outlet of the path. The transporting step preferably includes vibrating the particles of tobacco between the inlet and the outlet of the path. The contacting step can include admitting steam into the path at a pressure of between 2.5 and 25 bar (preferably between 5 and 12 bar) absolute pressure. Such contacting step preferably further includes heating the steam which is about to enter the path to a temperature of between 126° and 400° C., preferably between 150° and 300° C.

The method preferably further comprises the steps of maintaining the particles in the path at a pressure which at least approximates or equals or slightly exceeds atmospheric pressure, and of maintaining the particles of tobacco in the path for intervals exceeding three seconds. The contacting step preferably includes effecting condensation of steam on the particles of tobacco in the path.

The method further comprises the step of reducing the moisture content of heated tobacco particles including subjecting the particles which leave the path via the outlet to an intensive drying action. This can be achieved by suspending the particles of tobacco in a stream of hot gaseous fluid, by drying the particles of tobacco with a hot gas in a stream dryer or by drying the particles of tobacco with dry steam in a steam dryer.

The transporting step preferably includes admitting the particles of tobacco into a tunnel and vibrating the tunnel so as to impart to the particles a component of movement in a direction from the inlet toward the outlet of the path. Such tunnel is preferably provided with first and second elongated walls disposed substantially opposite one another and extending between the inlet and the outlet of the path. The contacting step then preferably includes admitting streamlets of steam through one of the walls (e.g., the bottom wall of the tunnel) toward the other (top) wall with attendant entrainment of tobacco particles by the streamlets against the other wall where the particles rebound on their way toward the outlet.

Another feature of the invention resides in the provision of an apparatus for increasing the specific volume of (puffing) tobacco particles, especially comminuted tobacco ribs. The apparatus comprises tobacco transporting means including an elongated tunnel having a tobacco admitting inlet at one end and a tobacco discharging outlet at the other end, and means for supplying into the tunnel steam at a pressure and a temperature such that the particles are heated to a temperature of between 100.5° and 120° C. (preferably between 102° and 110° C.) not later than on reaching the outlet of the tunnel. The transporting means preferably further comprises means for vibrating the tunnel. The supplying means preferably includes means for admitting into the tunnel steam at between 2.5 and 25 bar (preferably 5 and 12 bar) absolute pressure and at a temperature of between 126° and 400° C. (preferably between 150° and 300° C.). Means can be provided to maintain the interior of the tunnel at or slightly above atmospheric pressure (such means can comprise suitable cell wheels or other types of gates for sealing the inlet and the outlet of the tunnel save for admission of fresh tobacco particles and evacuation of heated tobacco particles. The transporting means is preferably arranged to transport the particles of tobacco from the inlet to the outlet at a speed and through a distance such that the period of dwell of tobacco particles in the path which is defined by the tunnel exceeds three seconds. The supplying means can be arranged to effect condensation of steam on the particles of tobacco in the tunnel with attendant heating of the particles.

The apparatus preferably further comprises a dryer which is arranged to receive particles of tobacco leaving the tunnel by way of the aforementioned outlet. The dryer can be a fluidized bed dryer which contacts the particles of tobacco with a hot gaseous fluid or a stream dryer which contacts the particles of tobacco with a hot gas or dry steam.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
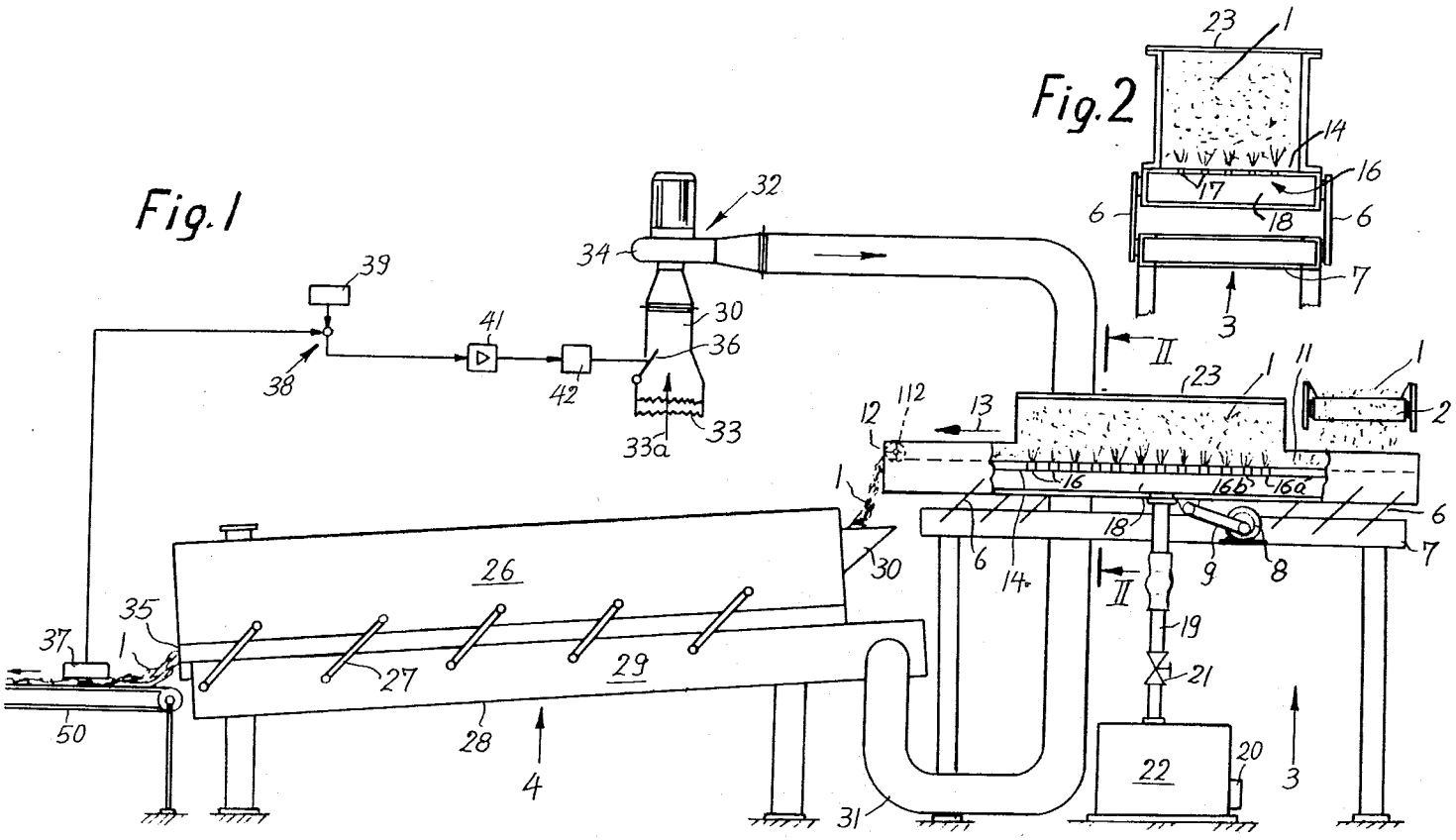
FIG. 1 is a somewhat schematic partly elevational and partly longitudinal vertical sectional view of an apparatus which can be used for the puffing of comminuted tobacco ribs and/or other portions of tobacco leaves and which is constructed, assembled and operated in accordance with the present invention.
FIG. 2 is a fragmentary transverse vertical sectional view as seen in the direction of arrows from the line II—II of FIG. 1.

The apparatus which is shown in the drawing serves for the puffing of tobacco particles 1, for example, cut tobacco ribs. Such tobacco particles are stored in a suitable magazine (not shown) and are delivered to the apparatus by a belt conveyor 2. The apparatus comprises tobacco transporting means including an elongated tunnel shaped conveyor 3 which serves to transport the particles 1 from an inlet 11 to an outlet 12 in the direction of arrow 13. The transporting means further comprises a stationary frame 7 and means for vibrating the conveyor 3 (hereinafter called tunnel) in a direction to advance the particles 1 from the inlet 11 toward and through the outlet 12, i.e., along the elongated horizontal or nearly horizontal path which is defined by the tunnel and wherein the particles of tobacco are conditioned by ascending streamlets of steam. The connection between the frame 7 and the tunnel 3 comprises several sets of leaf springs 6 (see also FIG. 2) and the vibrating means comprises an electric motor 8 which vibrates the tunnel 3 by way of an eccentric and one or more links 9.

The outlet 12 of the tunnel 3 admits heated tobacco particles 1 into the inlet 30 of a dryer 4 which is designed to fluidize the particles 1 in order to effect a highly effective and rapid reduction of the moisture content of puffed material.

The tunnel 3 comprises a horizontal bottom wall 14 having several transversely extending rows 16 of perforations (e.g., round holes) 17 which admit streamlets of steam into the path for the tobacco particles 1. As shown in FIG. 2, each row 16 can comprise five equidistant holes 17. The total number of rows 16 is twelve. The bottom wall 14 constitutes the top wall of a steam supplying or admitting channel 18 which vibrates with the tunnel 3 and receives steam from a steam generator 22 by way of one or more conduits 19 containing regulating valve(s) 21 which serve to select the pressure of steam that flows into the channel 18. The temperature of steam which is supplied by the generator 22 can be regulated by a suitable regulating unit 20 of any known design.

The tunnel 3 further comprises a top wall or cover 23 which is disposed opposite the bottom wall 14 and serves to intercept the particles 1 which are lifted by the ascending streamlets of steam issuing from the holes 17. The tunnel 3 completely encloses the path for tobacco particles 1, at least in the region between the inlet 11 and the outlet 12. The openings in the inlet 11 and outlet 12 are preferably dimensioned in such a way that they permit the particles of tobacco to enter and leave the elongated path but that they do not permit pronounced (or any) communication between the interior of the tunnel 3 and the surrounding atmosphere. For example, the inlet 11 and/or the outlet may be provided with a conventional cell wheel (shown in the outlet 12, as at 112) in order to reduce the extent of or fully prevent communication between the interior of the tunnel and the atmosphere therearound.

The dryer 4 may be of the type as disclosed in commonly owned U.S. Pat. No. 3,877,469 granted Apr. 15, 1975 to Waldemar Wochnowski et al. The disclosure of each U.S. Patent mentioned herein is incorporated by reference. Thus, the dryer 4 is a so-called fluidized bed dryer wherein the moisture content of puffed tobacco particles 1 is reduced to a desired extent while the particles advance (primarily or exclusively as a result of vibration of the dryer) from the aforementioned inlet 30 to an outlet 35. The upper part of the dryer 4 constitutes a vibratory conveyor 26 which is secured to a stationary frame 28 by sets of leaf springs 27 or the like and which is vibrated by an electric motor and eccentric means (refer to the patent to Wochnowski et al.) or in any other suitable way. The frame 28 defines a channel 29 which admits a heating medium into the path of puffed tobacco particles 1 in the interior of the conveyor 26. The channel 29 receives a heating medium (e.g., air) from a conduit 31 whose inlet is connected with an adjustable hot air generator 32 including a fan 34 which draws atmospheric air by way of an intake pipe 130 containing an electric resistance heater 33 and an adjustable valve 36 in the form of a pivotable flap. By changing the angular position of the valve 36, it is possible to vary the temperature of air which enters the conduit 31 on its way into the channel 29 and thence into the interior of the vibratory conveyor 26.

The means for adjusting the valve 36 comprises a moisture detector 37 which is adjacent to the path of tobacco particles 1 on a take-off conveyor 50 receiving particles from the outlet 35 of the dryer 4. The detector 37 may be of the type known as HWK which is manufactured and sold by the assignee of the present application. It generates signals whose intensity and/or another characteristic is indicative of the final moisture content of puffed tobacco particles. Such signals are transmitted to the corresponding input of a signal comparing stage 38 another input of which is connected with the output of a source 39 (e.g., an adjustable potentiometer) of reference signals denoting the desired or optimum moisture content of puffed tobacco. If the signal from the detector 37 deviates from the reference signal, the stage 38 transmits a signal which is amplified at 41 and is transmitted to a servomotor 42 which changes the angular position of the valve 36 and hence the ratio of heated air to fresh atmospheric air in the air stream entering the conduit 31. An advantage of the just described air temperature regulating system is that the quantity of air entering the channel 29 (and thence the interior of the vibratory conveyor 26) remains unchanged while the temperature of such air is varied within the desired range. The arrangement is such that the servomotor 42 causes the valve 36 to admit a larger quantity of cool atmospheric air when the moisture content of tobacco particles on the take-off conveyor 50 is too low, and that the valve 36 reduces the rate of admission of cool air when the moisture content of tobacco particles 1 on the conveyor 50 is too high. The air which enters the pipe 130 in the direction of arrow **33*a* is heated by the resistance heater 33**.

The illustrated air heating system can be modified in a number of ways, e.g., by omitting the valve 36 and providing means for regulating the action of the heater 33 in response to signals from the detector 37, or by using the valve 36 in conjunction with an adjustable heater. As disclosed in the aforementioned patent to Wochnowski et al., the conveyor 26 is provided with a perforated bottom wall which permits hot air to rise into the path of advancing puffed tobacco particles 1 and to maintain such particles in suspended condition while the particles advance from the inlet 30 toward the outlet 35. Such mode of drying tobacco particles is highly effective so that the drying operation can be completed within a short interval of time and in a relatively short vibratory conveyor.

The mode of operation of the apparatus of FIGS. 1 and 2 is as follows:

The belt conveyor 2 delivers a continuous stream of tobacco particles (e.g., comminuted tobacco ribs) into the inlet 11 of the tunnel 3 which is vibrated by the motor 8. The channel 18 admits streamlets of steam into the interior of the tunnel 3 via holes 17 in the bottom wall 14. The particles 1 which advance into the range of streamlets issuing from the holes 17 forming the foremost row **16*a* of such holes in the bottom wall 14 are lifted by ascending steam and are caused to impinge upon and to rebound at the underside of the top wall 23 while simultaneously moving in the direction of arrow 13 as a result of vibratory movements of the tunnel 3. In other words, each particle 1 which reaches the top wall 23 has a component of movement in the direction of arrow 13 as well as a component of movement downwardly toward the bottom wall 14 (under the action of gravity and/or as a result of rebounding at the underside of the top wall 23). This moves such particles into the range of streamlets of steam ascending from the holes 17 of the second row 16*b* whereby the aforedescribed procedure is repeated with the same result, i.e., the particles advance into the range of streamlets of steam ascending from the holes 17 of the third row, and so forth. Steam which is supplied by the steam generator 22 can be saturated or superheated steam, and its pressure at the locus of entry into the interior of the tunnel 3 is preferably between 2.5 and 25 bar absolute pressure, preferably in excess of 3 bar and most preferably between 5 and 12 bar. Depending on the nature of selected steam, one can achieve a more or less pronounced deposition of condensate on the particles of tobacco in the tunnel 1** with attendant release of heat and pronounced puffing of tobacco particles as a result of evaporation of moisture in the interior of such particles. It has been found that rapid and intensive heating of tobacco particles to a temperature in the range of or exceeding 100° C. (e.g., between 100.5° and 120° C., preferably between 102° and 110° C.) results in a highly pronounced puffing with an increase of specific volume of tobacco particles in excess of 50 percent.

The length of the tunnel 3 and/or the nature of vibratory movements to which the particles 1 of tobacco are subjected therein and/or the pressure of steam entering the tunnel 3 via holes 17 is preferably selected in such a way that the period of dwell of each particle in the path between the conveyor 2 and the inlet 30 of the dryer 4 is in excess of three seconds.

The freshly puffed particles 1 enter the vibratory conveyor 26 via inlet 30 and are subjected to intensive drying under the action of hot air which is supplied by the conduit 31 and enters the path of tobacco particles in the dryer 4 via holes in the bottom wall of the conveyor 26. The temperature of hot air in the conduit 31 is regulated in the aforedescribed manner, i.e., in response to signals which are generated by the moisture detector 37. Rapid drying of the particles which have been puffed in the aforedescribed manner ensures that the volume of the puffed particles does not decrease, i.e., that the specific volume of such particles is not reduced at all or that the reduction is marginal.

It is clear that the illustrated dryer 4 constitutes but one of numerous available means for effecting rapid and pronounced drying of freshly puffed tobacco particles 1 which issue from the outlet 12 of the tunnel 3. For example, the illustrated dryer 4 can be replaced with a so-called stream dryer which is known from the field of tobacco processing and operates with a hot gas (e.g., hot air) or dry steam. A suitable stream dryer for tobacco is disclosed, for example, in U.S. Pat. No. 4,308,676. Furthermore, the illustrated dryer 4 can be modified replacing hot air with dry steam which is caused to rise in the form of streamlets via holes in the bottom wall of the conveyor 26 so as to convert the particles 1 in the conveyor 26 into a mass of suspended particles which float in a body of dry steam on their way from the inlet 30 toward the outlet 35.

EXAMPLE 1

The puffing was carried out in an apparatus wherein the width of the tunnel 3 was 200 mm, the height of the tunnel was 200 mm and the length of the tunnel was 1000 mm. The bottom wall 14 of the tunnel was formed with twelve rows 16 of holes 17 each of which had a diameter of 0.8 mm. The conveyor 2 was set to deliver 400 kg of cut tobacco ribs per hour; this corresponded to a period of dwell of tobacco particles in the tunnel in the range of fifteen seconds. The initial moisture content of tobacco particles was 25 percent and their initial temperature was approximately 20° C. The tobacco channel 18 was supplied with saturated steam at a pressure of approximately 10 bar and at a temperature of approximately 183° C. The temperature of tobacco particles issuing at the outlet 12 was 105° C. and their moisture content was 35 percent. Upon drying, the increase of specific volume of tobacco particles was in excess of 50 percent.

EXAMPLE 2

The tunnel 3 was devoid of specially designed sealing means for the inlet 11 and outlet 12. The tunnel was vibrated, its width was 400 mm, its height was 150 mm, its length was 2000 mm, and its bottom wall had a total of seven transversely extending rows of fifteen holes each, each with a diameter of 0.8 mm. The interior of the tunnel received streamlets of superheated steam at 11 bar absolute pressure (10 bar overpressure) and at a temperature of 240° C. The period of dwell of tobacco particles in the tunnel was in the range of eight seconds. The moisture content of puffed particles decreased from the initial value of 30 percent to 28 percent. The output of the puffing unit was 1200 kg per hour. The puffing effect was excellent. It has been noted that the drying is more pronounced if the temperature of steam is increased, i.e., in response to further superheating of steam.

The transition to higher steam temperatures is beneficial not only as regards the puffing of tobacco particles but also as concerns the savings in energy. Thus, if the drying of tobacco particles is effected partially in the tunnel 3, the energy consumption of the dryer 4 (to heat atmospheric air at 33) or an analogous dryer is much less pronounced. This applies especially in connection with the utilization of superheated steam which not only effects rapid heating (and hence puffing) of tobacco particles in the tunnel 3 but also contributes to satisfactory and desirable drying of tobacco particles in the puffing path proper. Such drying in the tunnel is especially desirable when the treated material consists of comminuted tobacco ribs whose moisture content at the time of cutting is preferably in the range of between 28 and 34 percent and which must be dried to a much lower moisture content for further processing. Some drying in the tunnel 3 greatly relieves the next-following dryer 4. Readily detectable drying of tobacco particles in the tunnel 3 will take place when the temperature of steam is raised to 300° C. and if the pressure of steam is raised to a value at which the steam is superheated.

As mentioned above, the preferred temperature range of tobacco particles which leave the tunnel 3 is between 102° and 110° C. Moreover, the puffing takes place gently and the taste of tobacco particles remains substantially unchanged as a result of puffing in spite of a pronounced increase of the specific volume. This is in contrast to heretofore known proposals involving treatment of tobacco particles, for example, with superheated steam which is maintained at a temperature in excess of 300° C. and which is used to heat the particles to a temperature well in excess of the aforementioned range of between 102° and 110° C.

If the temperature of tobacco particles in the tunnel 3 is to be raised to between 110° and 120° C., the inlet and the outlet of the tunnel are preferably sealed from the surrounding atmosphere, e.g., by means of the aforediscussed cell wheels or in any other suitable way which does not interfere with predictable admission of tobacco particles into, and predictable evacuation of particles from, the tunnel.

The initial moisture content of tobacco particles 1 which are treated in the tunnel 3 can remain unchanged by appropriate superheating of steam which is admitted into the tunnel via holes 17 of the bottom wall 14. This prevents condensation of steam on the particles of tobacco and the wetting of such particles. More satisfactory distribution of ascending streamlets of steam in the tunnel 3 can be achieved if the holes 17 in the neighboring rows 16 of holes of the bottom wall 14 are staggered with reference to each other. As mentioned above, the rate and mode of admission of steam into the tunnel 3 can be such that the particles of tobacco are heated to requisite temperature while floating in a bed of steam. Such fluidized bed heating is also highly effective and can be completed within reasonably short intervals of time. As a rule, the period of dwell of tobacco particles in the tunnel is not less than three seconds and preferably not less than five seconds.

It has been found that the treatment of tobacco particles 1 in the tunnel 3 is particularly effective if the interior of the tunnel is maintained at, close to or slightly above atmospheric pressure. This is desirable on the ground that cool atmospheric air cannot enter the tunnel 3 via inlet 11 and/or outlet 12 so that the atmospheric air cannot interfere with predictable heating of the particles under the action of steam which is admitted via holes 17. In addition to or in lieu of cell wheels (such as 112), the means for sealing or substantially sealing the interior of the tunnel 3 from the surrounding atmosphere can comprise suspended strips or flaps of synthetic plastic material, air curtains and/or others. The provision of cell wheels is desirable and advantageous when the interior of the tunnel 3 is to be maintained above atmospheric pressure.

The drying of freshly puffed particles preferably follows immediately the completion of heating in the tunnel 3; this ensures that the specific volume of puffed tobacco particles is not reduced or is not reduced to an appreciable extent.

If the tobacco particles 1 are, or include relatively large quantities of, comminuted tobacco ribs, the ultimate (puffed) product is of desirable flaky or similar consistency.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of increasing the specific volume of tobacco particles, especially comminuted tobacco ribs, comprising the steps of transporting the particles into the inlet of, along and through the outlet of a predetermined path, including vibrating the path and the particles of tobacco between said inlet and outlet; sealing the particles of tobacco in said path from the surrounding atmosphere, at least in regions other than said inlet and said outlet; and contacting the particles of tobacco in said path with steam including conveying steam transversely of said path at a temperature and pressure such that the temperature of tobacco particles is raised to between 100.5° and 120° C. not later than when the particles reach the outlet of said path, said contacting step including condensation of steam on tobacco particles.

2. The method of claim 1, wherein said contacting step includes heating the particles of tobacco to a temperature of between 102° and 110° C.

3. The method of claim 1, wherein said contacting step includes admitting into said path steam at between 2.5 and 25 bar absolute pressure.

4. The method of claim 3, wherein the steam pressure is between 5 and 12 bar.

5. The method of claim 3, wherein said contacting step further includes heating the steam which is about to enter said path to a temperature of between 126° and 400° C.

6. The method of claim 5, wherein the temperature of steam is between 150° and 300° C.

7. The method of claim 1, further comprising the step of maintaining the particles of tobacco in said path at a pressure which at least approximates atmospheric pressure.

8. The method of claim 1, further comprising the step of maintaining the particles of tobacco in said path at slightly above atmospheric pressure.

9. The method of claim 1, further comprising the step of maintaining the particles of tobacco in said path for intervals of time exceeding three seconds.

10. The method of claim 1, further comprising the step of reducing the moisture content of heated tobacco particles including subjecting the particles leaving said path via said outlet to an intensive drying action.

11. The method of claim 10, wherein said step of reducing the moisture content of tobacco particles includes suspending the particles in a stream of hot gaseous fluid.

12. The method of claim 10, wherein said step of reducing the moisture content of tobacco particles includes drying the particles with a hot gas in a stream dryer.

13. The method of claim 10, wherein said step of reducing the moisture content of tobacco particles includes drying the particles with dry steam in a stream dryer.

14. The method of claim 1, wherein said transporting step includes admitting the particles of tobacco into a tunnel and vibrating the tunnel so as to impart to the particles a component of movement in a direction from the inlet toward the outlet of said path.

15. The method of claim 14, wherein the tunnel has first and second walls disposed substantially opposite one another and extending between the inlet and the outlet of said path, said contacting step including admitting streamlets of steam through one of the walls toward the other wall with attendant entrainment of tobacco particles against the other wall whereon the particles rebound on their way toward the outlet of said path.

16. Apparatus for increasing the specific volume of tobacco particles, especially comminuted tobacco ribs, comprising tobacco transporting means including an elongated tunnel having a tobacco admitting inlet and a tobacco discharging outlet, and means for vibrating said tunnel; and means for supplying into said tunnel steam at a pressure and temperature such that the particles are exposed to steam and are heated to a temperature of between 100.5° and 120° C., not later than on reaching said outlet, said supplying means being arranged to effect condensation of steam on the particles of tobacco in said tunnel.

17. The apparatus of claim 16, wherein said supplying means is arranged to supply to said tunnel steam at a temperature and at a pressure such that the particles of tobacco are heated to a temperature of between 102° and 110° C.

18. The apparatus of claim 16, wherein said supplying means includes means for admitting into said tunnel steam at between 2.5 and 25 bar absolute pressure and at a temperature of between 126° and 400° C.

19. The apparatus of claim 18, wherein the pressure of steam is between 5 and 12 bar.

20. The apparatus of claim 18, wherein the temperature of steam is between 150° and 300° C.

21. The apparatus of claim 16, further comprising means for maintaining the interior of said tunnel at or slightly above atmospheric pressure.

22. The apparatus of claim 16, further comprising means for at least substantially sealing said inlet and said outlet.

23. The apparatus of claim 16, wherein said transporting means is arranged to transport the particles of tobacco from said inlet to said outlet at a speed and through a distance such that the period of dwell of particles in said tunnel exceeds three seconds.

24. The apparatus of claim 16, further comprising a dryer arranged to receive particles of tobacco leaving said tunnel by way of said outlet.

25. The apparatus of claim 24, wherein said dryer is a fluidized bed dryer arranged to contact the particles of tobacco with a hot gaseous fluid.

26. The apparatus of claim 24, wherein said dryer is a stream dryer arranged to contact the particles of tobacco with a hot gas or dry steam.

* * * * *

UNITED STATES PATENT AND TRADEMARK OFFICE

CERTIFICATE OF CORRECTION

PATENT NO. : 4,766,912

DATED : August 30, 1988

INVENTOR(S) : Klaus-Georg HACKMACK et al.

It is certified that error appears in the above-identified patent and that said Letters Patent are hereby corrected as shown below: Title page:

Inventors: "Klaus-Georg Hackman" should read --Klaus-Georg Hackmack--.

Col. 6, line 53: before "replacing" insert --by--.

Signed and Sealed this

Fourth Day of April, 1989

*Attest:*

*Attesting Officer*

DONALD J. QUIGG

*Commissioner of Patents and Trademarks*